US010736444B1

(12) United States Patent
Leach

(10) Patent No.: US 10,736,444 B1
(45) Date of Patent: Aug. 11, 2020

(54) ADJUSTABLE BODY PILLOW

(71) Applicant: Jamie S. Leach, Ada, OK (US)

(72) Inventor: Jamie S. Leach, Ada, OK (US)

( * ) Notice: Subject to any disclaimer, the term of this patent is extended or adjusted under 35 U.S.C. 154(b) by 547 days.

(21) Appl. No.: 15/403,711

(22) Filed: Jan. 11, 2017

Related U.S. Application Data

(60) Provisional application No. 62/280,060, filed on Jan. 18, 2016.

(51) Int. Cl.

| | |
|---|---|
| ***A47C 20/00*** | (2006.01) |
| ***A47G 9/10*** | (2006.01) |
| ***A47G 9/02*** | (2006.01) |
| *A47C 20/02* | (2006.01) |

(52) U.S. Cl.
CPC ..... *A47G 9/1072* (2013.01); *A47G 9/0253* (2013.01); *A47G 9/1081* (2013.01); *A47C 20/00* (2013.01); *A47C 20/02* (2013.01); *A47C 20/025* (2013.01); *A47G 9/1027* (2013.01); *A47G 2009/1018* (2013.01)

(58) Field of Classification Search
CPC .. A47G 9/1072; A47G 9/0253; A47G 9/1081; A47G 9/1027; A47G 2009/1018; A47C 20/025; A47C 20/026; A47C 20/027; A47C 20/021; A47C 20/00; A47C 20/02; A47D 13/083
See application file for complete search history.

(56) References Cited

U.S. PATENT DOCUMENTS 726,164 A * 4/1903 Hogan ..... A61G 13/12 5/630
941,043 A * 11/1909 Powell ..... A47G 9/10 5/640
1,386,652 A * 8/1921 Patton ..... A47G 9/10 5/636
D201,492 S 6/1965 Jacobson
3,327,330 A * 6/1967 McCullough ..... A47G 9/10 5/636
3,604,026 A * 9/1971 Scheips ..... A47C 7/383 297/397
4,173,048 A 11/1979 Varaney
(Continued)

OTHER PUBLICATIONS

The Leachco Two-By-You product shown in the packaging material attached as Exhibit 1 was in public use and/or on sale at least since about Oct. 12, 2005.

(Continued)

*Primary Examiner* — Peter M. Cuomo
*Assistant Examiner* — Morgan J McClure
(74) *Attorney, Agent, or Firm* — Mary M. Lee

(57) ABSTRACT

An adjustable body pillow with connectors for arranging the pillow in multiple configurations. The pillow includes a center section, a first shorter leg, a second longer leg, and a plurality of connectors. Each connector is connectable to each other connector. The connectors include a first connector on the free end of the shorter leg, a second connector on the outer periphery of the body pillow at the junction between the other end of the shorter leg and one end of the center section, a third connector in the body receiving space at the junction between one end of the longer leg and the other end of the center section, and a fourth connector on the free end of the longer leg. Using the connectors, the body pillow can be arranged in various positions depending on the changing needs of the user.

28 Claims, 5 Drawing Sheets

(56) References Cited

U.S. PATENT DOCUMENTS 4,574,412 A * 3/1986 Smith ..... A47G 9/10 5/490
4,624,021 A * 11/1986 Hofstetter ..... A47C 20/021 5/632
4,731,890 A 3/1988 Roberts
4,834,459 A 5/1989 Leach
4,861,109 A 8/1989 Leach
D303,897 S 10/1989 Phillips
4,876,755 A * 10/1989 Parrish ..... A47C 7/425 297/284.3
D309,018 S 7/1990 Leach
5,035,013 A * 7/1991 Bloom ..... A47D 13/063 190/1
5,097,551 A * 3/1992 Smith ..... A47C 20/021 5/652
5,103,514 A 4/1992 Leach
5,154,649 A * 10/1992 Pender ..... A47D 13/083 5/490
5,325,818 A 7/1994 Leach
5,519,906 A 5/1996 Fanto-Chan
5,581,833 A 12/1996 Zenoff
5,586,351 A * 12/1996 Ive ..... B60N 2/26 5/655
D377,881 S * 2/1997 Watt ..... D6/596
5,647,076 A * 7/1997 Gearhart ..... A47C 20/025 5/631
D382,435 S 8/1997 Schaffner et al.
5,778,470 A 7/1998 Haider
D409,038 S 5/1999 Rojas et al.
D413,751 S * 9/1999 Alyea ..... 5/655
5,978,990 A 11/1999 Akey
5,987,674 A 11/1999 Schaffner et al.
6,003,177 A * 12/1999 Ferris ..... A61F 5/01 5/636
D420,845 S * 2/2000 Rumage ..... D6/601
6,052,848 A * 4/2000 Kelly ..... A47C 20/021 5/630
6,055,687 A 5/2000 Matthews
6,088,854 A * 7/2000 Brownrigg ..... A47C 20/021 5/632
D431,745 S 10/2000 Jackson
6,189,169 B1 * 2/2001 Marcotte ..... A47D 13/083 5/490
6,253,400 B1 * 7/2001 Rudt-Sturzenegger ..... A47D 13/083 5/630
6,279,185 B1 8/2001 Matthews
D453,653 S * 2/2002 Tunnell ..... A47C 20/021 D6/601
6,343,727 B1 2/2002 Leach
6,354,665 B1 3/2002 Ross
6,412,127 B1 * 7/2002 Cuddy ..... A47C 20/026 5/632
6,427,251 B1 8/2002 Leach
6,499,164 B1 * 12/2002 Leach ..... A47C 20/021 5/630
6,499,165 B1 12/2002 Morgillo
6,553,590 B1 4/2003 Leach
6,601,252 B1 8/2003 Leach
6,641,221 B1 * 11/2003 Kastlunger ..... A47C 7/383 297/392
6,751,817 B1 * 6/2004 Leach ..... A47C 20/021 5/630
6,760,934 B1 7/2004 Leach
6,779,211 B1 * 8/2004 Williams ..... A47D 13/08 5/640
6,874,183 B1 * 4/2005 Taylor ..... A47C 20/021 5/630
7,010,821 B1 3/2006 Leach
7,114,206 B2 10/2006 Leach
7,331,073 B2 * 2/2008 Littlehorn ..... A47C 7/38 5/632
7,353,552 B2 4/2008 Leach
7,451,508 B2 * 11/2008 Matthews Brown .. A47D 13/08 5/490
7,500,278 B2 3/2009 Leach
7,513,001 B1 4/2009 Leach
7,562,406 B1 7/2009 Leach
7,578,013 B2 * 8/2009 Aikman ..... A47C 20/021 340/573.1
7,657,955 B1 * 2/2010 Alvistur ..... A47D 13/083 5/639
7,676,871 B1 3/2010 Leach
D614,430 S * 4/2010 Watanabe ..... D6/601
7,708,342 B2 5/2010 Leach
7,793,371 B1 * 9/2010 Leach ..... A47C 20/021 5/630
7,878,587 B1 2/2011 Leach
7,926,135 B1 4/2011 Leach
8,136,186 B1 3/2012 Leach
8,146,760 B1 4/2012 Leach
D669,724 S * 10/2012 Kokoshari ..... D6/601
8,419,128 B1 4/2013 Leach
8,448,275 B1 5/2013 Leach
8,468,627 B2 6/2013 Leach
8,479,334 B1 7/2013 Leach
8,495,775 B2 * 7/2013 Fair ..... A47D 13/083 5/652
8,555,429 B2 10/2013 Leach
D697,336 S * 1/2014 Perry ..... D21/803
8,661,586 B2 * 3/2014 Melcher ..... A47C 20/00 5/630
8,661,587 B1 * 3/2014 Leach ..... A47D 13/08 5/630
8,661,588 B1 3/2014 Leach
8,671,480 B1 3/2014 Leach
8,708,414 B2 * 4/2014 Hurwitz ..... B60N 2/882 297/393
8,914,927 B1 12/2014 Leach
9,003,565 B1 4/2015 Leach
9,021,635 B1 5/2015 Leach
9,032,572 B1 5/2015 Leach
D736,011 S * 8/2015 Fresonke ..... D6/601
9,101,169 B1 8/2015 Leach
9,113,718 B1 8/2015 Leach
9,307,842 B2 * 4/2016 Gibbons ..... A47C 20/025
D755,541 S * 5/2016 Blay ..... D6/601
D761,593 S * 7/2016 Blay ..... D6/601
D765,442 S * 9/2016 Yaakov ..... D6/601
D766,016 S * 9/2016 Fornango ..... D6/601
D768,409 S * 10/2016 Park ..... D6/601
9,635,956 B1 5/2017 Leach
9,693,638 B1 * 7/2017 Leach ..... A47D 13/08
D817,031 S * 5/2018 Denat ..... D6/601
D838,123 S * 1/2019 Ye ..... D6/601
2004/0060116 A1 * 4/2004 Matthews Brown .. A47C 7/383 5/636
2005/0278864 A1 12/2005 Leach
2007/0022526 A1 2/2007 Leach
2007/0028384 A1 2/2007 Leach
2007/0046084 A1 3/2007 Leach
2007/0067914 A1 * 3/2007 Littlehorn ..... A47C 16/02 5/632
2007/0151031 A1 * 7/2007 Leach ..... A47C 20/021 5/632
2007/0163048 A1 * 7/2007 Kimball ..... A47C 20/021 5/632
2007/0277321 A1 12/2007 Leach
2008/0148487 A1 * 6/2008 Lord ..... A47C 20/021 5/632
2010/0175192 A1 * 7/2010 Aiken ..... A47C 20/021 5/632
2012/0073055 A1 * 3/2012 Cupo ..... A47C 7/38 5/636
2014/0082845 A1 * 3/2014 Pastrmac ..... A47C 20/027 5/636
2015/0366361 A1 * 12/2015 Lee ..... A47C 20/025 5/632

(56) References Cited

U.S. PATENT DOCUMENTS

| | | | | |
|---|---|---|---|---|
| 2016/0106238 | A1* | 4/2016 | Vargas | A47C 20/023 5/636 |
| 2016/0286981 | A1* | 10/2016 | Barsosky | A47D 13/083 |
| 2018/0009346 | A1* | 1/2018 | Ugran | B60N 2/882 |

OTHER PUBLICATIONS

The Leachco Lil' Snoogle product, which is shown and described in the webpage attached as Exhibit 2, was in public use and/or on sale at least as early as about Dec. 1999. "Lil' Snoogle" [online] webpage retrieved from http://www.leachco.stores.yahoo.net/lilsnoogle.html, Leachco, Inc., Ada, Oklahoma, USA. The first publication late of this reference is unknown. This document was published prior to the effective filing date, namely, Oct. 4, 2016, and prior to any foreign priority date of the present application. [retrieved on Oct. 11, 2007].

The Leachco All Nighter product, which is shown and described in the webpage attached as Exhibit 3, was in public use and/or on sale at least as early as about May 2002. "All Nighter" [online] webpage retrieved from http://www.leachco.stores.yahoo.net/allnighter.html, Leachco, Inc., Ada, Oklahoma, USA. The first publication date of this reference is unknown. This document was published prior to the effective filing date, namely, Oct. 4, 2016, and prior to any foreign priority date of the present application. [retrieved on Oct. 11, 2007].

The Leachco Prop Ease product, which is shown and described in the packaging material attached as Exhibit 4, was in public use and/or on sale at least as early as about 2005.

The Leachco Snoogle product, which is shown and described in the webpage attached as Exhibit 5, was in public use and/or on sale at least as early as about May 1999. "Snoogle Original" [online] webpage retrieved from http://www.leachco.stores.yahoo.net/snoogle.html, Leachco, Inc., Ada, Oklahoma, USA. The first publication date of this reference is unknown. This document was published prior to the effective filing date, namely, Oct. 4, 2016, and prior to any foreign priority date of the present application. [retrieved on Oct. 8, 2007].

The Leachco Mini Snoogle product, which is shown and described in the webpage attached as Exhibit 6, was in public use and/or on sale at least as early as about Dec. 1999."Snoogle Mini" [online] webpage retrieved from http://www.leachco.stores.yahoo.net/lisnde.html, Leachco, Inc., Ada, Oklahoma, USA. The first publication date of this reference is unknown. This document was published prior to the effective filing date, namely, Oct. 4, 2016, and prior to any foreign priority date of the present application. [retrieved on Oct. 11, 2007].

The Leachco Snoogle Loop product, which is shown and described in the webpage attached as Exhibit 7, was in public use and/or on sale at least as early as about Dec. 1999."Snoogle Loop" [online] webpage retrieved from http://www.leachco.stores.yahoo.net/snoogleloop.html, Leachco, Inc., Ada, Oklahoma, USA. The first publication date of this reference is unknown. This document was published prior to the effective filing date, namely, Oct. 4, 2016, and prior to any foreign priority date of the present application. [retrieved on Jun. 19, 2008].

The Leachco Snoozoo product, which is shown and described in the webpage attached as Exhibit 8, was in public use and/or on sale at least as early as about May 2005. "Snoozoo" [online] webpage retrieved from http://www.leachco.stores.yahoo.net/snoozoo.html, Leachco, Inc., Ada, Oklahoma, USA. The first publication date of this reference is unknown. This document was published prior to the effective filing date, namely, Oct. 4, 2016, and prior to any foreign priority date of the present application. [retrieved on Oct. 11, 2007].

The Leachco Snoogle Half-Time product, which is shown and described in the webpage attached as Exhibit 9, was in public use and/or on sale at least as early as about Jul. 2005. "Snoogle Half-Time" [online] webpage retrieved from http://www.leachco.stores.yahoo.net/snha.html, Leachco, Inc., Ada, Oklahoma, USA. The first publication date of this reference is unknown. This document was published prior to the effective filing date, namely, Oct. 4, 2016, and prior to any foreign priority date of the present application. [retrieved on Oct. 11, 2007].

The Leachco Back 'N Belly product, which is shown and described in the webpage attached as Exhibit 10, was in public use and/or on sale at least as early as about Jun. 2003. "Back 'N Belly" [online] webpage retrieved from http://www.leachco.stores.yahoo.net/backnbelly.html, Leachco, Inc., Ada, Oklahoma, USA. The first publication date of this reference is unknown. This document was published prior to the effective filing date, namely, Oct. 4, 2016, and prior to any foreign priority date of the present application. [retrieved on Oct. 11, 2007].

The Leachco Grow to Sleep pillow. which is shown and described in the webpage attached as Exhibit 11, was in public use and/or on sale at least as early as about August 8, 2005. "Grow to Sleep" [online] webpage retrieved from http://www.leachco.stores.yahoo.net/growtosleep.html, Leachco, Inc., Ada, Oklahoma, USA. The first publication date of this reference is unknown. This document was published prior to the effective filing date, namely, Oct. 4, 2016, and prior to any foreign priority date of the present application. [retrieved on Jun. 18, 2008].

The Leachco Preggle product, which is shown and described in the webpage attached as Exhibit 12, was in public use and/or on sale at least as early as about Dec. 2006. "Preggle" [online] webpage retrieved from http://www.leachco.stores.yahoo.net/preggle.html, Leachco, Inc., Ada, Oklahoma, USA. The first publication date of this reference is unknown. This document was published prior to the effective filing date, namely, Oct. 4, 2015, and prior to any forein priority date of the present publication. retrieved on [May 16, 2009].

The Leachco Boomerest product shown in the packaging material attached as Exhibit 13 was in public use and/or on sale at least since about May 1, 2005.

The Leachco Body Cloud product shown in the packaging material attached as Exhibit 14 was in public use and/or on sale at least since about Oct. 22, 2010.2006.

* cited by examiner

ADJUSTABLE BODY PILLOW

CROSS-REFERENCE TO RELATED APPLICATIONS

This application claims the benefit of U.S. provisional application No. 62/280,060 entitled "Adjustable Body Pillow," filed Jan. 18, 2016 the contents of which are incorporated herein by reference.

FIELD OF THE INVENTION

The present invention relates generally to pillows and, more particularly but without limitation, to body pillows.

DETAILED DESCRIPTION OF THE PREFERRED EMBODIMENTS

Body pillows enjoy increasing popularity among consumers. While one major use is to provide back and belly support for expectant mothers, many others use body pillows for supporting the body while sleeping or reclining. The present invention provides a body pillow with connectors that enable it to be arranged in several different configurations depending on the changing needs of the user.

Figure 1:
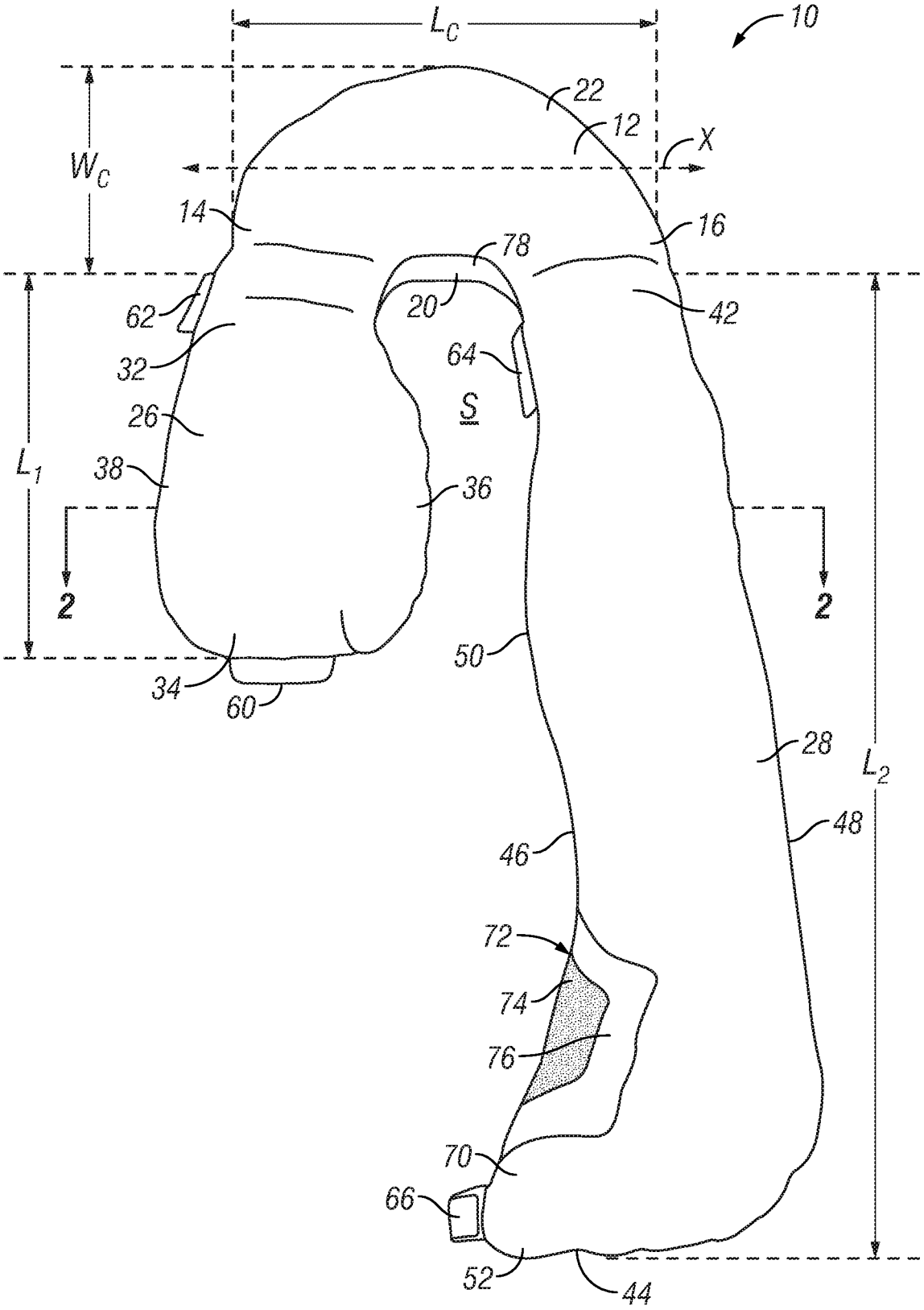
FIG. 1 is a plan view of an adjustable body pillow shown in its resting position.
Figure 2:
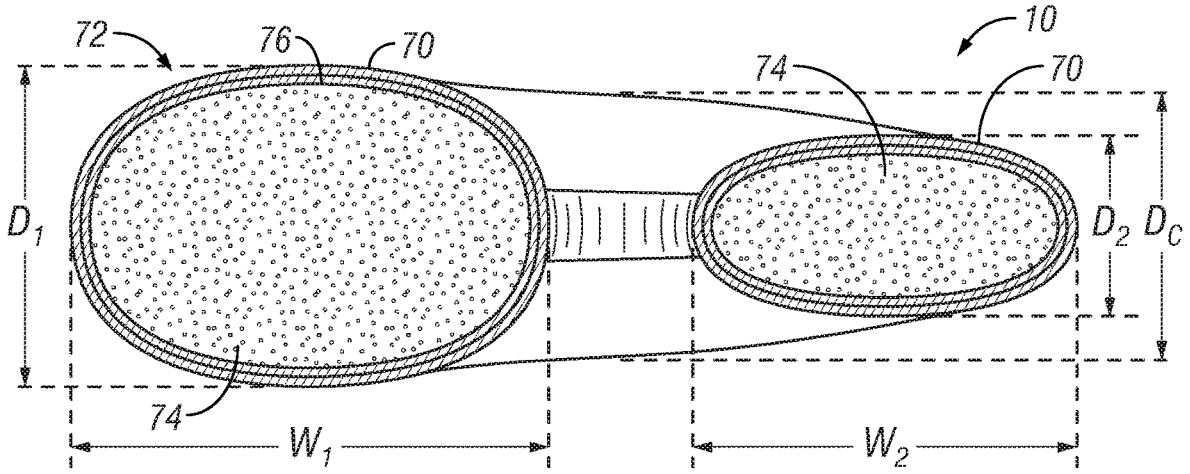
FIG. 2 is a cross-sectional view taken along line 2-2 of FIG. 1.

Turning now to the drawings in general and to FIGS. 1 and 2 in particular, there is shown an adjustable body pillow made in accordance with a preferred embodiment of the present invention and designated generally by the reference number 10. The pillow 10 comprises an elongate center section 12 with a first end 14, a second end 16, and defining a longitudinal axis X. In the preferred embodiment, the center section 12 has an inner perimeter 20 forming a continuous curve and an outer perimeter 22 also forming a continuous curve. However, the curved shape of the either or both of the inner and outer perimeters 20 and 22 may vary. By way of example, either the inner or outer perimeter 20, 22 may have a straight section terminating in opposing corners.

With continuing reference to FIGS. 1 and 2, the pillow 10 may include a first, shorter leg 26 and a second, longer leg 28. The first, shorter leg 26 includes a first end 32, a second end 34, an inner perimeter 36, and an outer perimeter 38. The first end 32 is connected to the first end 14 of the center section 12. The length, size, and shape of the first leg 26 may vary. However, in the preferred form, the first leg is bulbous, that is, the first leg is generally rounded in all dimensions extending from the first end 32.

The second leg 28 has a first end 42, a second end 44, an inner perimeter 46, and an outer perimeter 48. The first end 42 is connected to the second end 16 of the center section 12. The length, size, and shape of the second leg 28 may vary.

However, in the preferred form, the second leg 28 is about twice the length of the shorter leg 26. In a most preferred form, the inner perimeter 46 of the second leg 28 defines an inwardly extending bulge 50, that is, a curve that extends towards the second end 34 of the first leg 26. Still further, the second end 44 of the second leg 28 may include an inwardly turned toe 52.

As best seen in FIG. 1, the shorter leg 26 and the longer leg 28 both extend at an angle relative to the longitudinal axis X of the center section 12 in the same plane. In this way, when the body pillow 10 is in the resting state (FIG. 1), the inner perimeter 20 of the center section 12 and the inner perimeters 36 and 46 of the first and second legs 26 and 28 are continuous and together form a generally C-shaped body receiving space S. Similarly, the outer perimeter 22 of the center section 12 and the outer perimeters 38 and 48 of the first and second legs 26 and 28 are continuous and together form a generally C-shaped outer periphery.

As used herein, "C-shaped" means a shape with two generally opposing legs extending at an angle form a center section. "C-shaped" is not limited to a continuously curved shape. Rather, "C-shaped" includes a straight center section, angled center section, and a curved center section. Additionally, "C-shaped" includes a shape with two legs of equal length or unequal length, and also includes legs that are parallel to each other as well as legs that converge or diverge from the center section. Still further, "C-shaped" includes a shape with legs that are both straight, with legs that are both curved, or with one curved leg and one straight leg. The legs of a "C-shaped" form may both extend at the same angle from the center section or at different angles. Where the legs extend from the center section at different angles the two angles may or may not be complementary.

The body pillow 10 further comprises a plurality of connectors. The plurality of connectors includes a first connector 60 on the second end 34 of the shorter leg 26 and a second connector 62 on the on the outer periphery of the body pillow 10 at the junction between the first end 32 of the shorter leg and the first end 14 of the center section 12. The connectors also include a third connector 64 in the body receiving space S at the junction between the first end 42 of the longer leg 28 and the second end 16 of the center section 12 and a fourth connector 66 on the second end 44 of the longer leg. Ideally, the fourth connector 66 is on the toe 52.

Each of the plurality of connectors 60, 62, 64, and 66 is connectable to each of the other of the plurality of connectors. To that end, the connectors 60, 62, 64, and 66 may be hook-and-loop type fasteners, as shown in the drawings. Alternately, the connectors 60, 62, 64, and 66 may be ties, hooks, buttons, snaps, or any similar device, and the plurality of connectors may include a combination of types of connectors.

The construction of the pillow 10 may vary. Preferably, as shown in FIGS. 1 and 2, the pillow 10 comprises a removable cover 70 and a pillow insert 72. The removable cover 70 may be of any suitable material. Most preferably, the cover 70 is unitary, that is, all the components are permanently attached to each other as by stitching. In this way, the cover 70 may be removed for laundering. This also allows the user to have additional covers for a single pillow insert. Openings (not shown) in the cover 70 may be included for removing and replacing the insert 72. These openings may be provided with zippers or other closures, such as ties, hooks, buttons, snaps, or any similar device.

The insert 72 may comprise one unitary member or multiple, separate sections. The insert(s) may comprise compressible, resilient filler 74 enclosed in a fabric enclosure 76. The fabric of the enclosure 76 may be any suitable fabric, including but not limited to waterproof nylon, flannel, or elastic fabrics, such as spandex or cotton-spandex blends. However, presently a polyester/cotton blend is preferred. A preferred filler material is polyester fiberfill. Other suitable fillers include down feathers, memory foam, and polystyrene pellets. Still further, the pillow insert(s) could be inflatable.

The removable cover 70 is shaped to conform to the shape of the body pillow 10 when the body pillow is in the resting position. When the pillow 10 includes a removable cover 70, the connectors 60, 62, 64 and 66 may be provided on the outside of the cover.

The cover 70 and or the enclosure 76 of the insert 72 may include a comfort panel or gusset sewn 78 (FIG. 1) into the inner perimeter 20 of the center section 12. This provides additional flexibility around the curved inner perimeter 20 allowing easier positioning of the pillow under the user's head and neck.

Exemplary, non-limiting dimensions of the pillow 10 include an over length of about 63 inches, that is, the width $W_C$ of the center section 12 may be about 13 inches, the length $L_C$ of the center section may be about 25.5 inches, and the depth $D_C$ of the center section may be about 8 inches. The length $L_1$, width $W_1$, and depth $D_1$ of the first leg 26 may be about 25 inches, 16 inches, and about 7.5 inches, respectively. The length $L_2$, width $W_2$, and depth $D_2$ of the second leg 28 may be about 50 inches, 15.5 inches, and about 8.5 inches, respectively. As illustrated in FIG. 1, the width of the second leg 28 varies along its length to provide the bulge 50 and toe 52.

In FIG. 1, the body pillow 10 is shown in its resting position. As used herein, "resting position" and "resting state" refers to the position and shape the pillow 10 naturally assumes when no tension or pressure is exerted on any part of it. As indicated, the connectors 60, 62, 64, and 66 allow the pillow to be arranged in different configurations.

Figure 3:
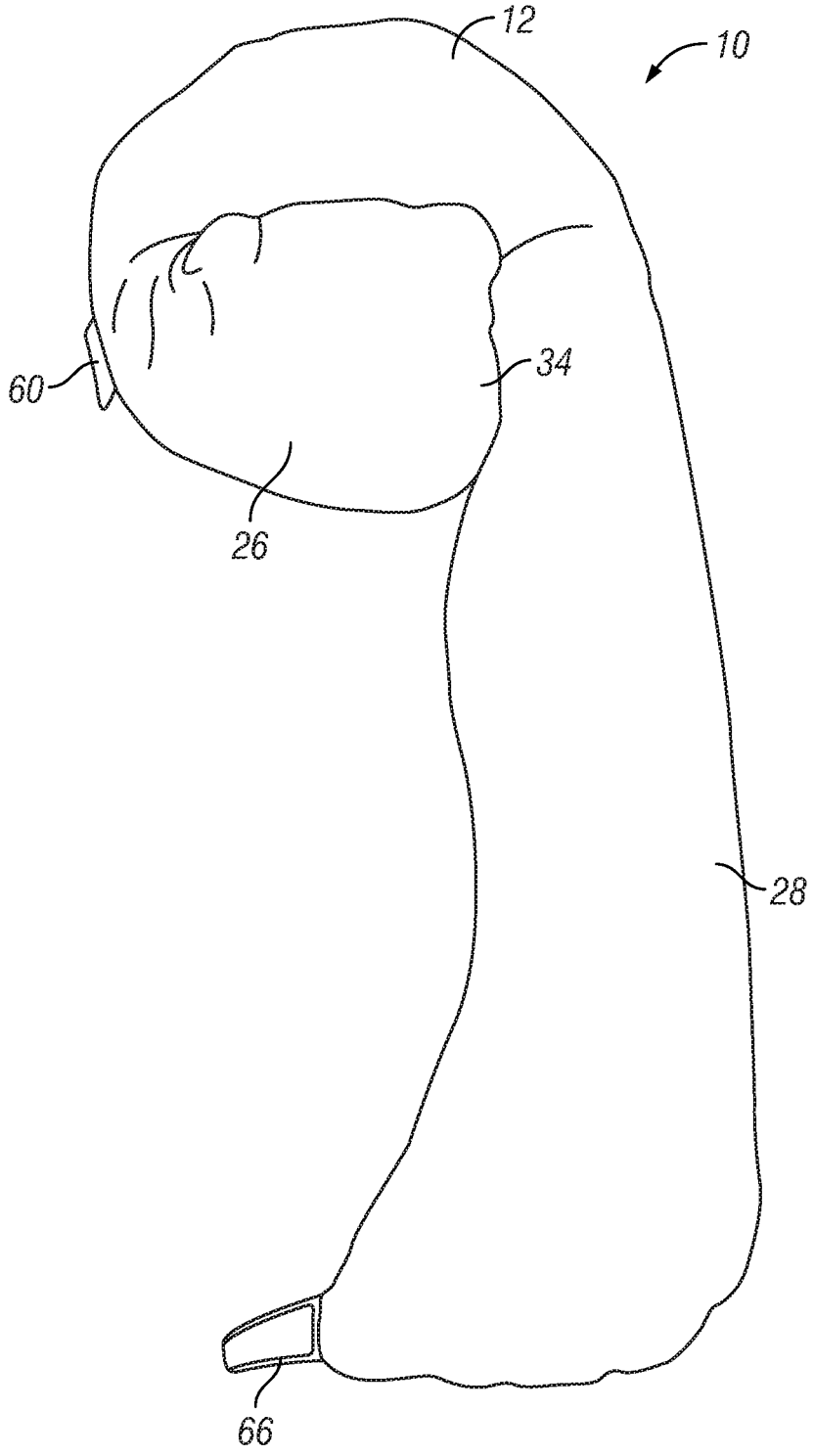
FIG. 3 is a plan view of the body pillow of FIG. 1 arranged in a first configuration.

FIG. 3 shows the pillow 10 arranged in a first configuration. In this configuration, the first connector 60 is connected to the third connector 64 so that the free end 34 of the first leg 26 is turned inside the body receiving space S.

Figure 4:
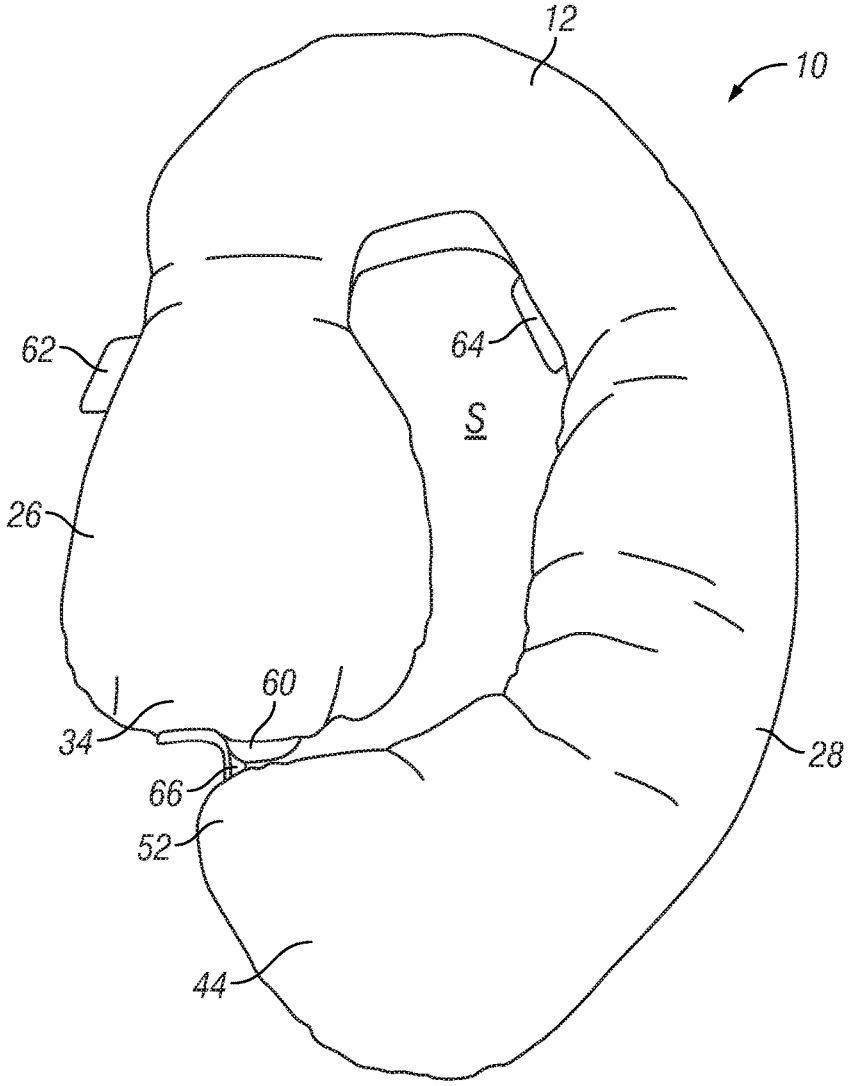
FIG. 4 is a plan view of the body pillow of FIG. 1 arranged in a second configuration.

FIG. 4 shows the pillow 10 arranged in a second configuration. In this configuration, the first connector 60 is connected to the fourth connector 66. This attaches the second end 34 of the first leg 26 to the toe 52 of the second leg 28, forming an enclosed body receiving space S.

Figure 5:
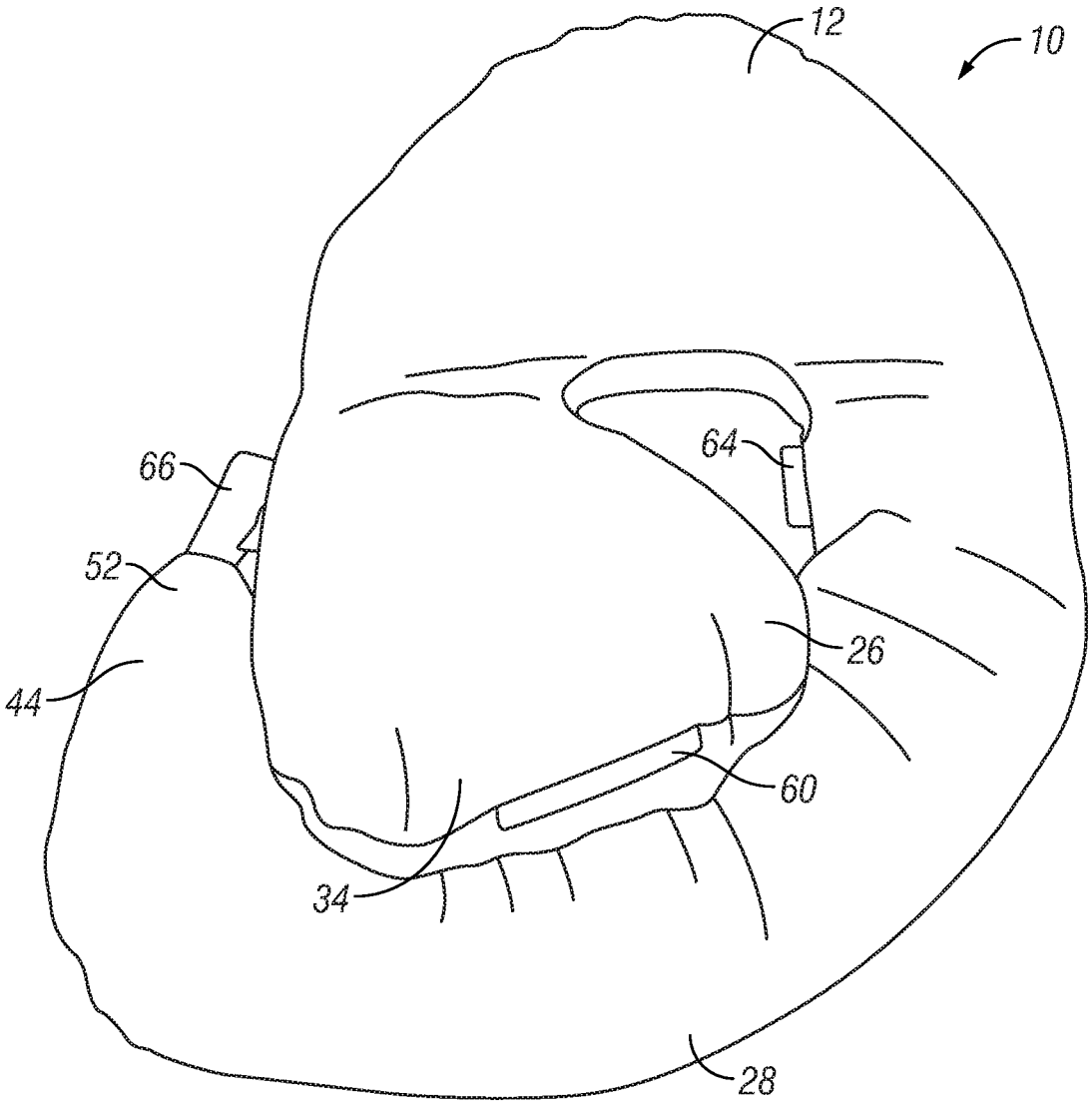
FIG. 5 a plan view of the body pillow of FIG. 1 arranged in a third configuration.

FIG. 5 shows the pillow 10 arranged in a third configuration. In this configuration, the second connector 62 is connected to the fourth connector 66. The free end 34 of the first leg 26 is curled inside the body receiving space S but is unattached and may be lifted up over the second leg 28.

Figure 6:
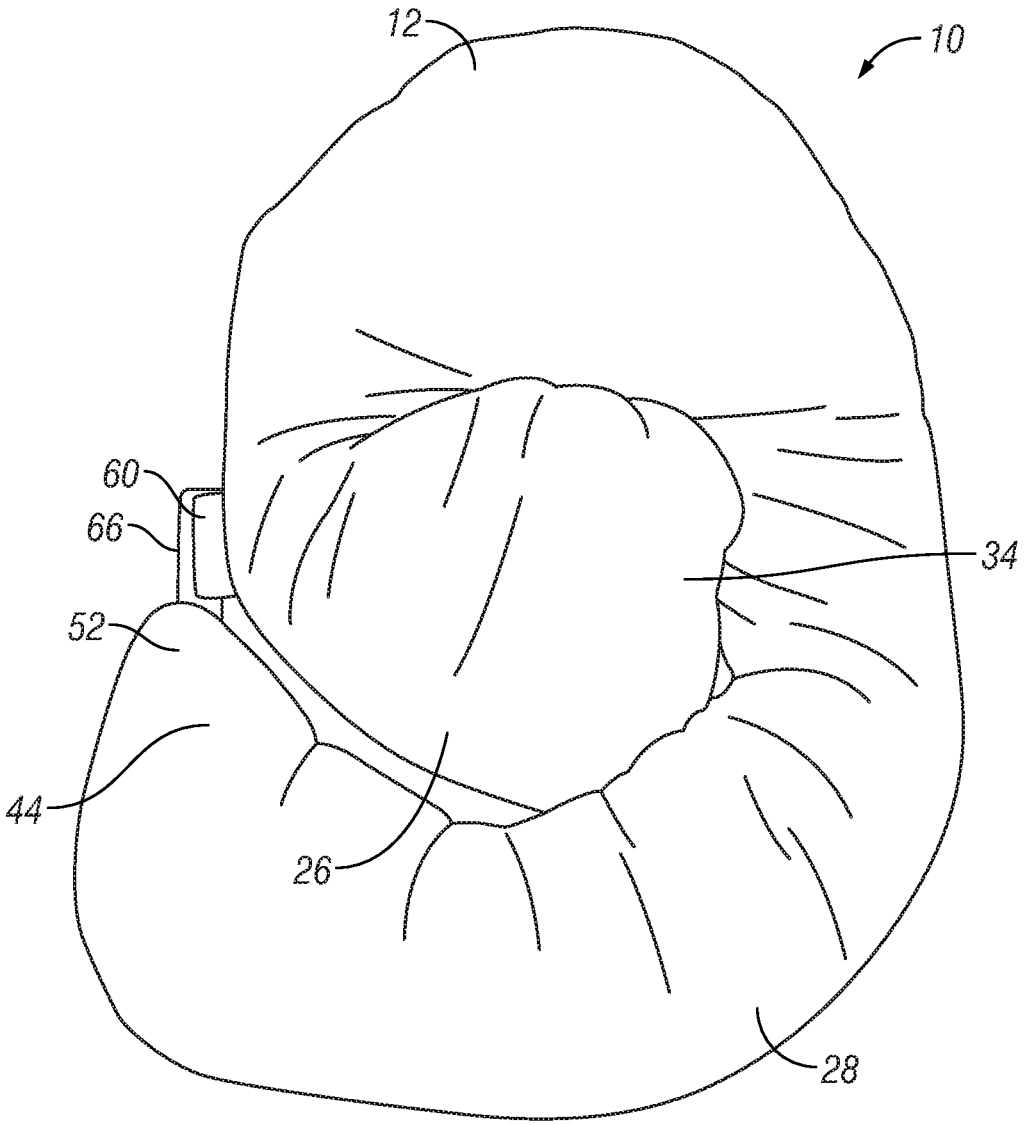
FIG. 6 a plan view of the body pillow of FIG. 1 arranged in a fourth configuration.

FIG. 6 shows the pillow 10 arranged in a fourth configuration. In this configuration, the first connector 60 is connected to the third connector 64, and the second connector 62 is connected to the fourth connector 66. This forms a more tightly curled arrangement, securing the free end 34 of the first leg 26 inside the second leg 28, forming a flat coil.

Now it will be appreciated that the present invention provides an adjustable body pillow with many advantages. In the preferred embodiment, the combination of the bulbous short leg, the elongate, contoured second leg, and the plurality of connectors at selected locations on the pillow, allows the pillow to be arranged temporarily but securely in several different configurations, depending on the user's needs.

The following issued US patents are incorporated herein by reference: (1) U.S. Pat. No. 7,793,371, entitled "Apparatus and Method for Question Mark-Shaped Body Pillow and Support System," issued Sep. 14, 2010; (2) U.S. Pat. No. 8,468,627, entitled "Elongated Angular Multiple Position Body Pillow," issued Jun. 25, 2013; (3) U.S. Pat. No. 7,353,552, entitled "Multiple Position Symmetrically Contoured Body Pillow," issued Apr. 8, 2008; (4) U.S. Pat. No. 6,499,164, entitled "Body Pillow With Horseshoe-Shaped Top and J-Shaped Bottom," issued Dec. 31, 2002; (5) U.S. Pat. No. 6,751,817, entitled "Contoured Body Pillow," issued Jun. 22, 2004; (6) U.S. Pat. No. 6,760,934, entitled "Symmetrically Contoured Support Pillow," Jul. 13, 2004; (7) U.S. Pat. No. 9,021,635, entitled "Body Pillow with Multiple Configurations," issued May 5, 2015. These patents describe the various techniques and materials related to the making of body pillows.

The embodiments shown and described above are exemplary. Many details are often found in the art and, therefore, many such details are neither shown nor described herein. It is not claimed that all of the details, parts, elements, or steps described and shown herein are newly invented. Changes may be made in the details, especially in matters of shape, size, and arrangement of the parts, within the principles of the invention to the full extent indicated by the broad meaning of the terms in the attached claims. The description and drawings of the specific embodiments herein do not point out what an infringement of this patent would be, but rather provide non-limiting examples of how to use and make the invention. Likewise, the abstract is neither intended to define the invention, which is measured by the claims, nor is it intended to be limiting as to the scope of the invention in any way. The limits of the invention and the bounds of the patent protection are measured by and defined in the following claims.

What is claimed is:

1. An adjustable body pillow comprising:

an elongate center section having a longitudinal axis, a first end, a second end, an inner perimeter, and an outer perimeter;

a first, shorter leg having a first end, a second end, an inner perimeter, and an outer perimeter, the first end connected to the first end of the center section;

a second, longer leg having a first end, a second end, an inner perimeter, and an outer perimeter, the first end connected to the second end of the center section;

wherein the shorter leg and the longer leg both extend at an angle relative to the longitudinal axis of the center section in the same plane so that, when the body pillow is in the resting state, the inner perimeters of the center section, the shorter leg, and the longer leg are continuous and together form a generally C-shaped body receiving space, and wherein the outer perimeters of the center section, the shorter leg, and the longer leg are continuous and together form a generally C-shaped outer periphery; and a plurality of connectors, each of the plurality of connectors being connectable to each of the other of the plurality of connectors, wherein the plurality of connectors includes a first connector on the second end of the shorter leg, a second connector on the outer periphery of the body pillow at the junction between the first end of the shorter leg and the first end of the center section, a third connector in the body receiving space at the junction between the first end of the longer leg and the second end of the center section, and a fourth connector on the second end of the longer leg.

2. The body pillow of claim 1 wherein the shorter leg is bulbous.

3. The body pillow of claim 2 wherein the longer leg includes an inwardly extending bulge along the inner perimeter opposite the second end of the shorter leg.

4. The body pillow of claim 3 wherein the longer leg includes an inwardly turned toe on the second end of the longer leg.

5. The body pillow of claim 4 wherein the longer leg is at least twice the length of the shorter leg.

6. The body pillow of claim 5 further comprising a removable cover shaped to conform to the shape of the body pillow when the body pillow is in the resting position and wherein the connectors in the plurality of connectors are on the outside of the cover.

7. The body pillow of claim 6 wherein the outer perimeter of the center section forms a continuous curve.

8. The body pillow of claim 1 wherein the longer leg includes an inwardly extending bulge along the inner perimeter opposite the second end of the shorter leg.

9. The body pillow of claim 1 wherein the longer leg includes an inwardly turned toe on the second end of the longer leg.

10. The body pillow of claim 1 wherein the longer leg is at least twice the length of the shorter leg.

11. The body pillow of claim 1 further comprising a removable cover shaped to conform to the shape of the body pillow when the body pillow is in the resting position and wherein the connectors in the plurality of connectors are on the outside of the cover.

12. The body pillow of claim 1 wherein the outer perimeter of the center section forms a continuous curve.

13. The body pillow of claim 1 wherein the first connector is connected to the fourth connector.

14. The body pillow of claim 1 where in the first connector is connected to the third connector.

15. The body pillow of claim 14 wherein the fourth connector is connected to the second connector.

16. The body pillow of claim 1 wherein the fourth connector is connected to the second connector.

17. A removable cover for an adjustable body pillow, wherein the cover is shaped to conform to the shape of the body pillow when the body pillow is in the resting position, wherein the body pillow comprises an elongate center section having a longitudinal axis, a first end, a second end, an inner perimeter, and an outer perimeter; a first, shorter leg having a first end, a second end, an inner perimeter, and an outer perimeter, the first end connected to the first end of the center section; a second, longer leg having a first end, a second end, an inner perimeter, and an outer perimeter, the first end connected to the second end of the center section; wherein the shorter leg and the longer leg both extend at an angle relative to the longitudinal axis of the center section in the same plane so that, when the body pillow is in the resting state, the inner perimeters of the center section, the shorter leg, and the longer leg are continuous and together form a generally C-shaped body receiving space, and wherein the outer perimeters of the center section, the shorter leg, and the longer leg are continuous and together form a generally C-shaped outer periphery; and wherein the cover further comprises:

a center section shaped to cover the center section of the body pillow;

a shorter leg shaped to cover the shorter leg of the body pillow;

a longer leg shaped to cover the longer leg of the body pillow; and a plurality of connectors, each of the plurality of connectors being connectable to each of the other of the plurality of connectors, wherein the plurality of connectors includes a first connector on the second end of the shorter leg of the cover, a second connector on the cover positioned to be on the outer periphery of the body pillow at the junction between the first end of the shorter leg and the first end of the center section of the body pillow, a third connector on the cover positioned to be in the body receiving space at the junction between the first end of the longer leg and the second end of the center section of the body pillow, and a fourth connector on the second end of the longer leg of the cover.

18. The body pillow cover of claim 17 wherein the shorter leg of the body pillow is bulbous.

19. The body pillow cover of claim 18 wherein the longer leg of the body pillow includes an inwardly extending bulge along the inner perimeter opposite the second end of the shorter leg of the body pillow.

20. The body pillow cover of claim 19 wherein the longer leg of the body pillow includes an inwardly turned toe on the second end of the longer leg of the body pillow.

21. The body pillow cover of claim 20 wherein the longer leg of the body pillow is at least twice the length of the shorter leg of the body pillow.

22. The body pillow cover of claim 21 wherein the outer perimeter of the center section of the body pillow forms a continuous curve.

23. The body pillow cover of claim 17 wherein the longer leg of the body pillow includes an inwardly extending bulge along the inner perimeter opposite the second end of the shorter leg of the body pillow.

24. The body pillow cover of claim 17 wherein the longer leg of the body pillow includes an inwardly turned toe on the second end of the longer leg of the body pillow.

25. The body pillow cover of claim 17 wherein the longer leg of the body pillow is at least twice the length of the shorter leg of the body pillow.

26. The body pillow cover of claim 17 wherein the outer perimeter of the center section of the body pillow forms a continuous curve.

27. A method for reconfiguring a body pillow, the method comprising:

providing a body pillow, wherein the body pillow comprises:

an elongate center section having a longitudinal axis, a first end, a second end, an inner perimeter, and an outer perimeter;

a first, shorter leg having a first end, a second end, an inner perimeter, and an outer perimeter, the first end connected to the first end of the center section;

a second, longer leg having a first end, a second end, an inner perimeter, and an outer perimeter, the first end connected to the second end of the center section;

wherein the shorter leg and the longer leg both extend at an angle relative to the longitudinal axis of the center section in the same plane so that, when the body pillow is in the resting state, the inner perimeters of the center section, the shorter leg, and the longer leg are continuous and together form a generally C-shaped body receiving space, and wherein the outer perimeters of the center section, the shorter leg, and the longer leg are continuous and together form a generally C-shaped outer periphery; and, a plurality of connectors, each of the plurality of connectors being connectable to each of the other of the plurality of connectors, wherein the plurality of connectors includes a first connector on the second end of the shorter leg, a second connector on the outer periphery of the body pillow at the junction between the first end of the shorter leg and the first end of the center section, a third connector in the body receiving space at the junction between the first end of the longer leg and the second end of the center section, and a fourth connector on the second end of the longer leg;

arranging the body pillow in a configuration selected from the group of configurations comprising a first configuration in which the first connector is connected to the third connector, a second configuration in which the first connector is connected to the fourth connector, a third configuration in which the second connector is connected to the fourth connector, and a fourth configuration in which the first connector is connected to the third and the second connector is connected to the fourth connector.

28. The method of claim 27 further comprising, after arranging the body pillow in a configuration selected from the group of configurations, rearranging the body pillow in another one of the configurations selected from the group of configurations.

* * * * *